US009605509B2

(12) United States Patent
Doane et al.

(10) Patent No.: US 9,605,509 B2
(45) Date of Patent: Mar. 28, 2017

(54) REMOVABLE TREATING PLUG WITH RUN IN PROTECTED AGGLOMERATED GRANULAR SEALING ELEMENT

(71) Applicant: BAKER HUGHES INCORPORATED, Houston, TX (US)

(72) Inventors: James C. Doane, Friendswood, TX (US); James G. King, Kingwood, TX (US); Jason M. Harper, Cypress, TX (US); Robert J. Taylor, Houston, TX (US); Bennett M. Richard, Kingwood, TX (US)

(73) Assignee: Baker Hughes Incorporated, Houston, TX (US)

( * ) Notice: Subject to any disclaimer, the term of this patent is extended or adjusted under 35 U.S.C. 154(b) by 362 days.

(21) Appl. No.: 14/292,390

(22) Filed: May 30, 2014

(65) Prior Publication Data

US 2015/0345244 A1 Dec. 3, 2015

(51) Int. Cl.
*E21B 33/12* (2006.01)

(52) U.S. Cl.
CPC ..... *E21B 33/1208* (2013.01)

(58) Field of Classification Search
CPC ..... E21B 29/02; E21B 33/12; E21B 33/1208; E21B 33/13; E21B 33/138
See application file for complete search history.

(56) References Cited

U.S. PATENT DOCUMENTS

| | | | | |
|---|---|---|---|---|
| 3,090,441 | A * | 5/1963 | Smink | E21B 27/02 166/162 |
| 4,797,159 | A * | 1/1989 | Spangle | C04B 2/102 106/694 |
| 5,709,269 | A | 1/1998 | Head | |
| 5,942,031 | A * | 8/1999 | Cheung | C04B 2/102 106/801 |
| 6,446,717 | B1 * | 9/2002 | White | E21B 33/1212 166/187 |
| 6,955,216 | B1 * | 10/2005 | Heijnen | E21B 27/02 166/100 |
| 7,093,664 | B2 | 8/2006 | Todd et al. | |
| 7,168,494 | B2 | 1/2007 | Starr et al. | |
| 7,216,706 | B2 * | 5/2007 | Echols | E21B 33/12 166/177.1 |
| 7,303,014 | B2 * | 12/2007 | Reddy | C04B 28/02 106/819 |
| 7,353,879 | B2 | 4/2008 | Todd et al. | |

(Continued)

*Primary Examiner* — Jennifer H Gay
(74) *Attorney, Agent, or Firm* — Steve Rosenblatt

(57) ABSTRACT

A fully disintegrating plug has a passage therethrough and a ball seat at an upper end. The seal material that comprises plastic nuggets, sand and a grease binder is initially disposed behind a protective sleeve. A wireline setting tool creates relative movement between a plunger and a mandrel body that has a ramp surface adjacent the outlet of the protective sleeve. The sleeve outlet is closed for running in but plunger movement pushes the seal material so as to displace the closure at the sleeve outlet with the seal material that is forced up the mandrel ramp surface and against the surrounding tubular. After an object is landed on the mandrel seat and the treating is concluded, the plug components are caused to disintegrate or otherwise fail for complete removal. Multiple plugs are contemplated for fracturing or other treating applications.

21 Claims, 1 Drawing Sheet

(56) References Cited

U.S. PATENT DOCUMENTS 7,404,440 B2 * 7/2008 Reddy ..... C04B 28/02 166/242.1
7,631,695 B2 * 12/2009 Schafer ..... E21B 33/1208 166/135
7,958,940 B2 6/2011 Jameson
8,056,638 B2 11/2011 Clayton et al.
8,136,594 B2 * 3/2012 Streich ..... C09K 8/42 166/292
8,162,054 B2 * 4/2012 Schultz ..... C09K 8/42 166/166
8,235,102 B1 8/2012 Robertson
8,256,521 B2 9/2012 Swor et al.
8,272,446 B2 9/2012 Swor et al.
8,291,969 B2 10/2012 Swor et al.
8,291,970 B2 10/2012 Swor et al.
8,322,449 B2 12/2012 Clayton et al.
8,327,926 B2 12/2012 Robertson
8,371,370 B2 * 2/2013 Xu ..... E03B 3/15 166/285
8,662,159 B2 * 3/2014 Xu ..... E03B 3/15 166/191
8,869,898 B2 * 10/2014 Xu ..... E21B 43/26 166/271
9,004,169 B2 * 4/2015 Huang ..... C04B 28/26 166/250.1
2005/0023003 A1 * 2/2005 Echols ..... E21B 33/12 166/384
2005/0205266 A1 9/2005 Todd et al.
2006/0086503 A1 * 4/2006 Reddy ..... C04B 28/02 166/293
2007/0209797 A1 * 9/2007 Brink ..... E21B 27/02 166/297
2008/0041591 A1 * 2/2008 Reddy ..... C04B 28/02 166/293
2009/0101364 A1 * 4/2009 Schafer ..... E21B 33/1208 166/387
2011/0042081 A1 * 2/2011 Streich ..... C09K 8/42 166/269
2011/0042082 A1 * 2/2011 Schultz ..... C09K 8/42 166/270
2011/0048743 A1 3/2011 Stafford et al.
2011/0132599 A1 * 6/2011 Xu ..... E03B 3/15 166/228
2011/0136707 A1 6/2011 Xu et al.
2011/0147014 A1 * 6/2011 Chen ..... E21B 33/1208 166/387
2011/0203795 A1 * 8/2011 Murphy ..... C09K 8/42 166/292
2012/0152524 A1 6/2012 Myers et al.
2012/0247772 A1 * 10/2012 Huang ..... C04B 28/26 166/300
2012/0292030 A1 * 11/2012 Xu ..... E21B 43/26 166/308.1
2012/0318513 A1 12/2012 Mazyar et al.
2013/0206425 A1 8/2013 Mazyar et al.
2013/0248194 A1 9/2013 Huang
2015/0211324 A1 * 7/2015 King ..... E21B 33/1208 166/285
2015/0345244 A1 * 12/2015 Doane ..... E21B 33/1208 166/285

* cited by examiner

REMOVABLE TREATING PLUG WITH RUN IN PROTECTED AGGLOMERATED GRANULAR SEALING ELEMENT

FIELD OF THE INVENTION

The field of the invention is treating plugs that have a removable structure and a collapsible sealing and gripping element.

BACKGROUND OF THE INVENTION

Intervals are fractured sequentially with fracture plugs used to isolate zones below that have already been fractured. When the entirety of the interval is fractured it is desirable to remove the balls that have landed on the various fracture plugs and this is frequently done with production flow. The balance of each plug that defined the seat for the ball is frequently drilled out to allow as large an open passage as possible for subsequent production or injection. Drilling the plugs out is a time consuming process and for that reason is expensive for the well operator in the form of added costs for rigs needed for the drilling out process.

Some examples of systems where plugs or parts thereof are drilled out are shown in U.S. Pat. No. 7,958,940 and 2012/0152524. In an effort to avoid having to drill out the plugs before production or injection other techniques have been tried such as making some of the plug parts from material that is strong enough to handle the pressure differential but breaks down under applied heat but that still requires drilling to remove remnants. This technique is shown in U.S. Pat. Nos. 8,322,449; 8,056,638; 8,291,969; 8,272,446; 8,235,102; 8,327,926; 8,291,970 and 8,256,521. Water and heat are used to create plug component decomposition in U.S. Pat. No. 7,093,664 and 2005/0205266. Coatings that get chemically attacked are shown in US 2012/0318513. Corrosion of plugs is featured in US 2013/0206425. Plugs for passages made of dissolvable natural rock are disclosed in US2013/0248194. Plugs where components break down with a chemical, nuclear or ultraviolet light source are described in U.S. Pat. Nos. 7,168,494 and 7,353,879.

More recently, controlled electrolytic materials have been described in US Publication 2011/0136707 and related applications filed the same day. The related applications are incorporated by reference herein as though fully set forth. What is needed and not provided in the art is a treating plug that has a sealing element that seals and fixates the plug against differential pressures. When it is time to remove the plug the body members of the plug are removed by a chemical agent and the sealing element is crushed or otherwise collapsed so that remnants can either be circulated out or fall to the hole bottom. The crushing of the element can also act to liberate the agent that removes the body portions of the plug or the agent can be either added to the wellbore or found in the wellbore. The desired result is the plugs with their ball seats are removed without drilling for maximizing flow either in production or injection after the fracturing is completed. The sealing element is run in behind a sleeve to protect it during running in. When the desired location is reached the seal material is wedged against the borehole wall by being forced out from behind the sleeve and up an adjacent ramp made of a disintegrating material. These and other aspects of the present invention will be more readily apparent to those skilled in the art from a review of the detailed description and the associated drawings while recognizing that the full scope of the invention is to be determined from the appended claims.

SUMMARY OF THE INVENTION

A fully disintegrating plug has a passage therethrough and a ball seat at an upper end. The seal material that comprises plastic nuggets, sand and a grease binder is initially disposed behind a protective sleeve. A wireline setting tool creates relative movement between a plunger and a mandrel body that has a ramp surface adjacent the outlet of the protective sleeve. The sleeve outlet is closed for running in but plunger movement pushes the seal material so as to displace the closure at the sleeve outlet with the seal material that is forced up the mandrel ramp surface and against the surrounding tubular. After an object is landed on the mandrel seat and the treating is concluded, the plug components are caused to disintegrate or otherwise fail for complete removal. Multiple plugs are contemplated for treating applications.

DETAILED DESCRIPTION OF THE PREFERRED EMBODIMENT

Figure 2:
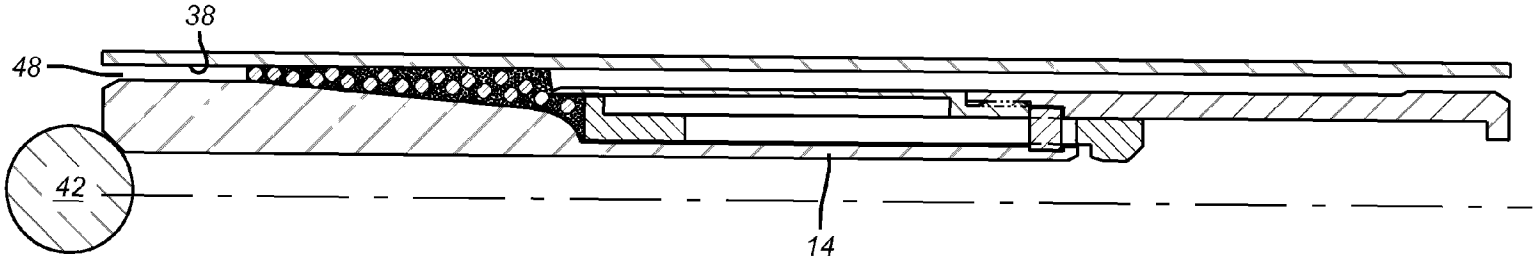
FIG. 2 is the view of FIG. 1 in the set position.

The plug 10 has a ramp 12 followed by a lower extension 14. Bottom sub 16 overlaps extension 14 at a distance that is spanned by connector 18. A plunger assembly 20 passes through connector 18 with an annularly shaped body 22 that terminates in a radial surface 24 that abuts the seal mixture 26. A sleeve 28 is secured to bottom sub 16 and serves to contain the mixture 26 for running in. An adhesive layer, dissolvable polymer or some other removable sealing material 30 is located at the upper end 32 of sleeve 28 to protect the mixture 26 from well fluids or impacts with the borehole wall that might dislodge some or all the mixture 26 before the plunger assembly 20 is actuated. The barrier 30 can be defeated with the advancing mixture 26 or with exposure to well fluids for a predetermined time. Arrows 34 and 36 represent the opposing forces created by the setting tool that is not shown when it is desired to set the plug at the appropriate location. A wireline setting tool such as the E-4 sold by Baker Hughes Incorporated of Houston, Tex. could be used to set the plug. As the setting tool is actuated there is relative movement of the plunger assembly 20 with respect to the mandrel 10. As a result the mixture 26 is pushed by the radial surface 24 onto the ramp 12 and against the borehole wall 38 as shown in FIG. 2. The resulting compaction from the plunger assembly 20 movement is a wedging and compaction of the mixture 26 to close openings among the ingredients so that leakage is minimized when treating differential pressures are applied. Absolute sealing is not critical in a fracturing context as long as the desired flow rate at the desired pressure gets into the formation to propagate fractures.

Through passage 40 is open for running in to expedite delivery to the desired location and to allow fluid ahead of the advancing plug to get behind it. After the plug is set in the FIG. 2 position an object, preferably a ball 42, is dropped and/or pumped.

After the treating procedure is completed, the disintegration process can be initiated with fluid delivered into the borehole or at least in part with fluid already present. The structural components of the plug are preferably made with a disintegrating material such as a controlled electrolytic material or CEM or a disintegrating polymeric or composite material. The mixture 26 will break into pieces once the plug structure adjacent to it begins the disintegration process.

Figure 1:
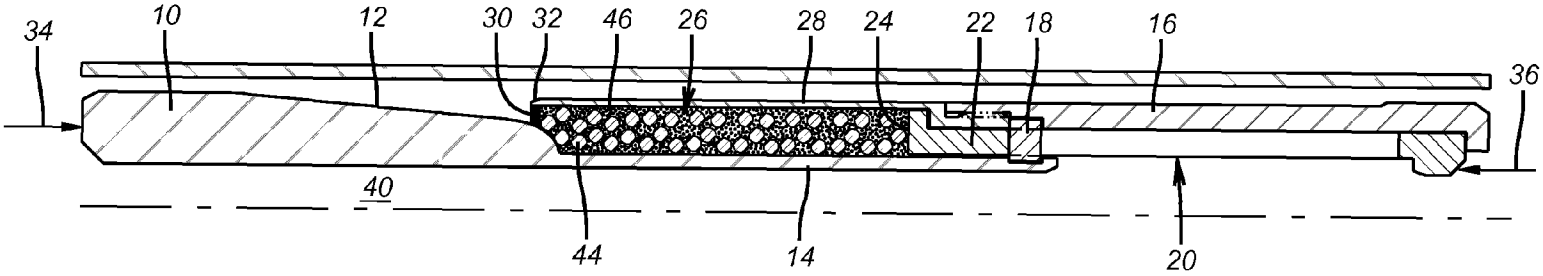
FIG. 1 is a half section view of the plug in the run in position.

The larger granular material 44 of the mixture 26 is too large to fit through the extrusion gap and prevents the smaller granular material 46 from flowing through the extrusion gap 48. The smaller material could be sand and the larger material could be CEM or dissolvable polymer Pellets (5/16" Dia.x5/16" long) or Chalk. The granular material could be mixed with grease to make it flow better out of the housing and prevent it from mixing with the well fluid. After the plug is set, a ball 42 is flowed down and landed on the top of the plug. High pressure is applied to the ball side of the plug. The granular material provides a seal and prevents the plug from moving. The ramp causes axial load from the pressure to result in a radial load on the granular material which allows it to seal and grip. The granular material will grip the casing which will prevent the plug from moving axially. The "adhesive" 30, shown in FIG. 1, is used to contain the granular material. The "adhesive" could be grease, silicon or a degradable polymer.

The larger particles 44 could be plastic pellets about 5/16 inch while the smaller particles can be #4 or #5 sand all of which can be held together with grease. The adhesive 30 can also be a strip that is dislodged under compaction pressure from movement of the plunger assembly 30.

Those skilled in the art will appreciate that the resulting plug is operational for isolation for treating operations such as fracturing, stimulating or acidizing or other procedures while presenting a structure and seal material mix that will break as the structural components disintegrate. Fluid such as acid can be delivered to the plug to initiate the disintegration process for the structural components followed by the seal mixture 26 breaking as it loses structural support to allow the pieces to either be circulated or reversed out or allowed to fall to the well bottom.

The above description is illustrative of the preferred embodiment and many modifications may be made by those skilled in the art without departing from the invention whose scope is to be determined from the literal and equivalent scope of the claims below:

We claim:

1. A disintegrating plug for subterranean use in a borehole defined by a borehole wall, comprising:

a mandrel having a selectively closed passage therethrough;

a sealing mixture initially disposed in a cavity defined by said mandrel said cavity having a selectively sealed outlet;

a plunger selectively movable with respect to said mandrel to push said sealing mixture out of said cavity and into an annular gap between said mandrel and the surrounding borehole wall; and said mandrel comprises an external ramp adjacent said selectively sealed outlet that changes the dimension of said annular gap.

2. The plug of claim 1, wherein:

said selectively sealed outlet is sealed with a material removed by movement of said sealing mixture due to movement of said plunger.

3. The plug of claim 1, wherein:

said selectively sealed outlet is sealed initially with an adhesive or a dissolvable polymer.

4. The plug of claim 1, wherein:

said mandrel and said plunger are made of a disintegrating material.

5. The plug of claim 1, wherein:

said plunger applies an axial force on said sealing mixture that is translated to a radial force on said sealing mixture by an adjacent ramp on said mandrel.

6. The plug of claim 1, wherein:

said sealing mixture is at least in part a granular material.

7. The plug of claim 6, wherein:

aid sealing mixture contains grease.

8. The plug of claim 1, wherein:

said sealing mixture contains granular particles of different sizes.

9. The plug of claim 8, wherein:

at least some of said granular particles comprise sand.

10. The plug of claim 1, wherein:

said sealing mixture contains pellets or chalk.

11. The plug of claim 10, wherein:

said pellets are made of controlled electrolytic material or a dissolvable polymer.

12. The plug of claim 1, wherein:

said outlet has a barrier that is removed with exposure to well fluids.

13. The plug of claim 1, wherein:

said sealing mixture is protected from impact during running in by said mandrel.

14. The plug of claim 1, wherein:

said sealing mixture is exclusively retained for running in by said mandrel cavity and said selectively sealed outlet.

15. A method of setting a removable plug for subterranean isolation, comprising:

locating a sealing mixture in a mandrel cavity;

selectively retaining said sealing mixture in said cavity;

forcing the sealing mixture from said cavity and against said mandrel and a surrounding borehole wall that define a tapering gap;

performing a subterranean operation after said forcing;

disintegrating said mandrel after said performing to release the sealing mixture from the surrounding borehole wall to break up for dropping in the borehole or for removal by circulation or reverse circulation;

leaving no part of the removable plug at the location where said plug was set after said disintegrating.

16. The method of claim 15, comprising:

using a cone on said mandrel and a plunger on said mandrel for said forcing.

17. The method of claim 16, comprising:

making said cone and plunger from a disintegrating material;

performing said selectively retaining with a material that is forced out by movement of said sealing mixture or by exposure of said material to well fluids.

18. The method of claim 15, comprising:

providing granular materials of different sizes mixed with grease as said sealing mixture.

19. The method of claim 18, comprising:

using disintegrating pellets made of a controlled electrolytic material or dissolvable polymer as one of said granular materials and sand as another of said granular materials.

20. The method of claim 15, comprising:

treating a formation by at least one of fracturing, acidizing, or stimulating.

21. A method of using the plug in claim 1 for a subterranean treating a formation by at least one of fracturing, acidizing, or stimulating, comprising setting the plug in a borehole;

performing fracturing, acidizing, or stimulating against the plug.

* * * * *